US006882275B2

(12) United States Patent
Blanpain et al.

(10) Patent No.: US 6,882,275 B2
(45) Date of Patent: Apr. 19, 2005

(54) MICROSYSTEM USING MAGNETOMETER AND INCLINOMETER FOR ANTI-THEFT PROTECTION OF VALUABLES

(75) Inventors: Roland Blanpain, Entre-Deux-Guiers (FR); Gilles Delapierre, Seyssins (FR)

(73) Assignee: Commissariat a l'Energie Atomique, Paris (FR)

( * ) Notice: Subject to any disclaimer, the term of this patent is extended or adjusted under 35 U.S.C. 154(b) by 199 days.

(21) Appl. No.: 10/220,632

(22) PCT Filed: Mar. 13, 2001

(86) PCT No.: PCT/FR01/00740

§ 371 (c)(1),
(2), (4) Date: Sep. 4, 2002

(87) PCT Pub. No.: WO01/69561

PCT Pub. Date: Sep. 20, 2001

(65) Prior Publication Data

US 2003/0076229 A1 Apr. 24, 2003

(30) Foreign Application Priority Data

Mar. 14, 2000 (FR) ..... 00 03237

(51) Int. Cl.[7] ..... G08B 13/14
(52) U.S. Cl. ..... 340/568.1; 324/247
(58) Field of Search ..... 340/568.1, 547, 340/637; 324/243, 244, 247

(56) References Cited

U.S. PATENT DOCUMENTS 3,611,345 A 10/1971 Pintell
3,781,664 A * 12/1973 Rorden ..... 324/247
5,331,561 A * 7/1994 Barrett et al. ..... 701/205
5,376,921 A * 12/1994 Trikilis ..... 340/551
5,910,774 A * 6/1999 Capriotti et al. ..... 340/637
6,150,810 A * 11/2000 Roybal ..... 324/244
6,310,549 B1 * 10/2001 Loftin et al. ..... 340/547
6,541,966 B1 * 4/2003 Keene ..... 324/243

FOREIGN PATENT DOCUMENTS

| | | |
|---|---|---|
| DE | 24 30 710 | 1/1976 |
| EP | 0 097 742 | 1/1984 |
| EP | 0 172 301 | 2/1986 |
| EP | 0 722 157 | 7/1996 |
| FR | 2 415 406 | 8/1979 |
| FR | 2 765 372 | 12/1998 |

* cited by examiner

*Primary Examiner*—John Tweel, Jr.
(74) *Attorney, Agent, or Firm*—Oblon, Spivak, McClelland, Maier & Neustadt, P.C.

(57) ABSTRACT

A device for the detection of movement of a valuable object, for example in a museum in which a device for detecting at least a rotation of the object, and particularly magnetometers or inclinometers, are mechanically fixed to the object. These detecting devices are coupled to a message transmission device that sends a presence message as long as detection has not taken place and an alert type message when detection has taken place. A monitoring station processes these messages or the absence of these messages, to trigger an alert if necessary.

15 Claims, 3 Drawing Sheets

MICROSYSTEM USING MAGNETOMETER AND INCLINOMETER FOR ANTI-THEFT PROTECTION OF VALUABLES

DOMAIN OF THE INVENTION

The invention relates to alert triggering assemblies when it is detected that a normally immobile object, for example an object of art exposed in a museum, moves abnormally. It also relates to a process for assistance with monitoring a set of objects and an object or set of objects equipped with means of detecting movements and sending messages.

PRIOR ART

Many systems have already been implemented to detect theft, attempted theft or an act of vandalism on objects displayed in museums. For example, these monitoring systems may include video camera assemblies monitoring art work to be protected. These systems require the presence of an operator to attentively monitor the image or images originating from each of the cameras. Magnetic marking systems have also been envisaged in which a magnetic resonator is included in the art work to be monitored. Movement of the art work in which the resonator is fitted is detected when the art work passes through a portal frame receiving a frequency corresponding to the resonant frequency of the resonator. This type of device only operates if the protected art work passes through the portal frame. The use of implantable electronic chips, infrared curtains, mercury ball contactors, piezoelectric devices and accelerometers have also been envisaged. These systems could be satisfactory if the rate of false alarms was not so high. This invention presents a new device to detect a movement of the protected object with a very low rate of false alarms.

BRIEF DESCRIPTION OF THE INVENTION

The purpose of this invention is a device to detect an abnormal movement, in other words different from "invisible" movements of an object considered to be immobile, of a protected art work. It applies to a device generating a very low or zero false alarm rate. It applies to a device designed to limit the number and vigilance of surveillance personnel. It is also designed to detect a theft or an attempted theft at the beginning of the infraction. In one particular embodiment, it is also designed to detect the approach of a metallic object, for example a cutting object. In another particular embodiment, it is designed to immediately identify the protected object on which an attempted theft is being made. For all these purposes, the invention relates to a device for triggering an alert or a pre-alert when it is detected that a normally immobile object moves, this device comprising:

measurement means generating measured values, means of transmitting measured values to means of processing the measured values, message transmission means, monitoring means comprising:

message reception means, means of triggering the alert, characterized in that:

the measurement means comprise at least one magnetometer with one or several axes fixed to the object and measuring the magnetic field along at least one axis, the processing means calculate a vector magnitude representative of a movement and possibly generate a movement detection signal by comparing the calculated vector magnitude with a threshold vector magnitude, based on a series of measurements from the measurement means, the means of triggering the alert being coupled to means of processing measurements and sending an alert message on reception of the detection signal from the said measurement processing means.

In one advantageous embodiment, the signals sent by the magnetometers and possibly other sensor means such as an inclinometer, are digital. Filtering may be done in the form of a Kalman filter designed to reduce the convergence time of the processing algorithm and to determine an average sliding value taking account of how the received values vary with time. In one version designed to reduce the possibilities of the device being decoyed, the detection means also comprise one or several inclinometers with one or several axes mechanically fixed to the object to be protected and coupled to the processing means. In one improved version designed to detect movements of the object and also a change in the magnetic conditions around the object, for example caused by bringing a metallic object closer, the device also comprises one or several additional magnetometers mechanically fixed to the object, and connected to the processing means. In one version designed to further reduce the possibilities of decoying, the device may comprise a magnetic field generator, for example a random field generator. This generator is coupled to the processing means so that the processing means are capable of continuously determining parameters defining a local magnetic field vector.

The distribution of means making up the alert triggering assembly can vary, depending on the applications; The means attached to the object may comprise means of making measurements, means of transmitting measurements, processing means and means of sending messages. In this case, the means of transmitting the measured values to the means of processing the measured values may consist of a simple link, for example a wire link. The alert triggering means in the monitoring station are coupled to the processing means through means of sending messages and means of receiving messages. In one simplified version, the means fixed to the object only comprise the measurement means and means of transmitting the measured values. In this case, the means of transmitting the measurements include message sending means. Means of triggering the alert are coupled to processing means through a simple link, for example a wire link.

The invention also relates to a process for monitoring an object or a set of objects in which each object communicates with a monitoring station, characterized in that at the object end:

at least one rotation movement of the object with an amplitude greater than a threshold is detected, at least one alert message is sent as soon as a rotation with an amplitude greater than the threshold is detected, and an alert is sent from the monitoring station as soon as an alert message is received.

The real movement of the object may be much more complex than a simple rotation, it may then be useful to detect a sequence of rotations that form this movement, in order to reduce the error rate. The magnitudes to be compared will then be calculated from a vector magnitude with several components.

In a more sophisticated version, designed particularly to control the case in which there is a failure of the electrical power supply to the means located on the object or if it has been neutralized, it is also possible to continuously send a presence message and to trigger the alert if an alert message is received or in the absence of a presence message for longer than a determined duration. If only the measurement means and the message transmission means are present at the object end, the presence message is composed of a message transmitting the values of the measurements made by the measurement means.

Preferably, presence and alert messages are transmitted in the form of a free electromagnetic wave. Preferably, the alert message is transmitted on a frequency different from the transmission frequency of the presence message.

In the preferred embodiment, the presence and alert messages comprise an identification code for the monitored object and/or a location of the monitored object. Also preferably, the alert transmission means are standard IR means, video means, etc.

Preferably, an alert causes the appearance of at least one signalled image of the object on a screen of a monitor of the monitoring station. The image is said to be signalled in the sense that the monitor on which the image is shown is for example indicated by a flashing lamp associated with the monitor or through a sound signal.

Finally, the invention relates to a monitored object characterized in that it comprises means of measuring a rotation movement of the object, these means being mechanically fixed to the object, for example one or several magnetometers, with one or several axes, possibly associated with one or several inclinometers with one or several axes, means of sending presence messages and alert messages, these means being coupled to processing means coupled to means of measuring an object rotation.

BRIEF DESCRIPTION OF THE DRAWINGS

The invention and variant embodiments will now be described with reference to the attached drawings in which.

DESCRIPTION OF EMBODIMENTS OF THE INVENTION

Figure 1:
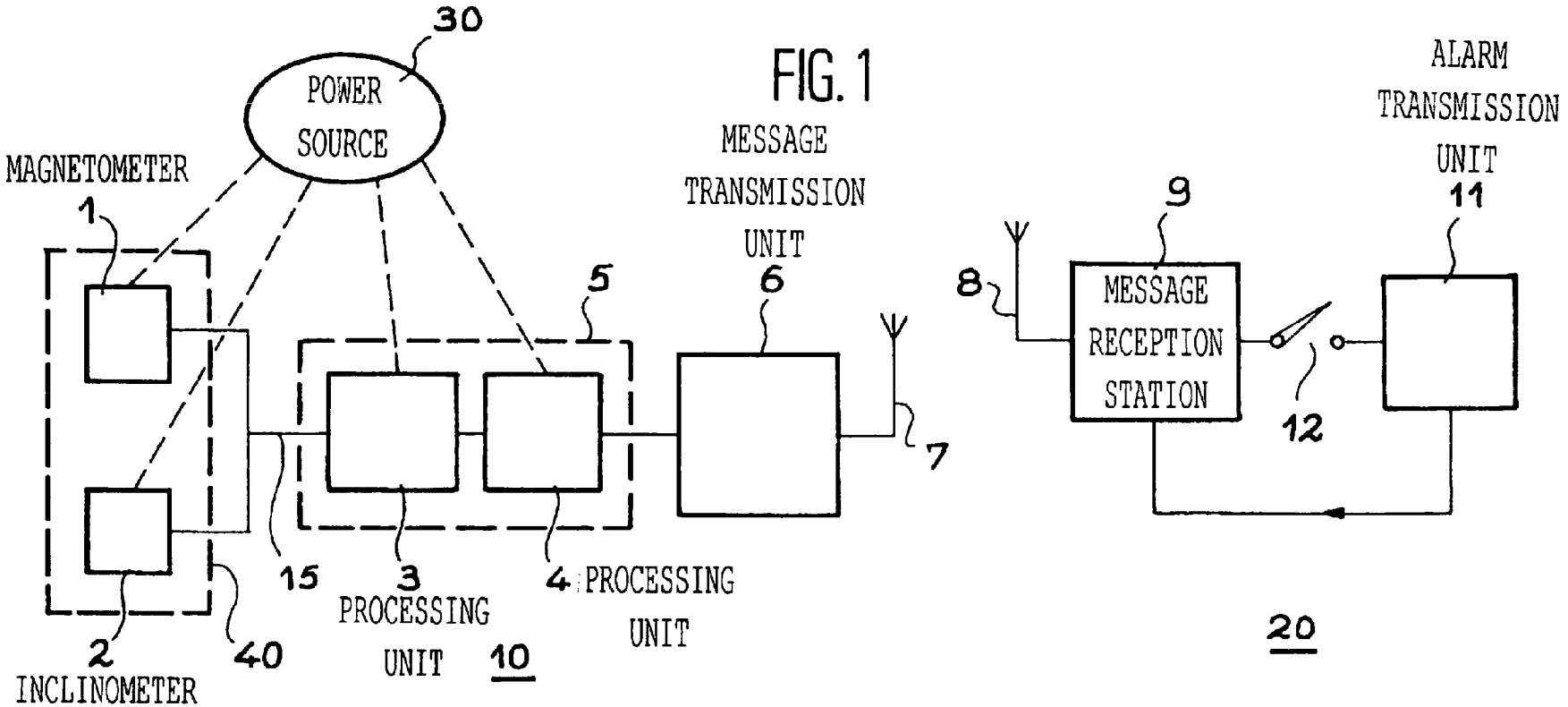
FIG. 1 shows a diagram of a device according to the invention.

With reference to FIG. 1, a device according to the invention comprises firstly means 10 fixed to the object together forming a detection station for the object to be protected, and secondly alarm reception and triggering means 20 together forming at least part of a monitoring station, and coupled to the different objects to be protected.

The detection means fixed to the object comprise firstly a magnetometer 1 coupled to processing means 5 by measurement transmission means 15, for example a wire link, these processing means being coupled to message transmission means 6 sending a message to a monitoring station 20 close to the object(s) to be monitored, through an antenna or other means 7. The means fixed to the object comprise an electrical power supply source 30 coupled to the component elements of these fixed means. This source may be a battery, a micro-battery, a cell for the transformation of an electromagnetic wave into an electrical current, or any other known means. The monitoring station 20 comprises firstly a message reception station 9 coupled through a switch 12 to alarm transmission means 11. The alarm transmission means 11 is coupled on return to the station 9 to enable an acknowledgement function, for example, after an alert, by resetting the alert trigger.

In FIG. 1, the means of communication between the detection station 10 and the alert station 20 are shown in the form of an antenna 7 coupled to the message transmission means 6 at the detection station and an antenna 8 coupled to the reception means 9 at the monitoring station 20. These antennas presuppose that the connection between the detection station 10 and the alert station 20 are made in the form of an electromagnetic link. This is the preferred embodiment. However, it is obvious that the link between the reception station 20 and the detection and transmission station 10 may be made by any other known connection means, and particularly a wire link or an infrared link. The signal processing means 5 comprise firstly means 3 of processing the magnetometer signal 1 and secondly means 4 for filtering this signal and detecting a movement. The means 3 receive data from the magnetometer 1 and process these data to generate at least one rotation vector or at least one component of this vector, for the magnetometer 1 with respect to the local magnetic field of the object. This rotation vector is then filtered by filtering means 4, for example a Kalman filter, or using a technique called the "maximum probability" technique or any algorithm related to detection/estimation in information theory, to detect a rotation with an amplitude greater than a fixed threshold and to trigger a message if the amplitude of the detected rotation is greater than the threshold. This device operates as follows.

The magnetometer 1 with one or several axes 1 continuously measures the magnetic field present on each of these axes. The value of the magnetic field present on each of these axes is continuously sent to the processing means 3. On reception of each set of values from the magnetometer 1, the processing means 3 generate the value of a rotation vector of the magnetic field picked up by each of the axes of the magnetometer 1 with respect to a natural or artificial magnetic field surrounding the object to be detected. Although in principle the object is motionless, this immobility is not absolute. Furthermore, the object is affected by natural seismic noise of the building in which the object is installed. Furthermore, the object is subjected to various vibrations due to the activity around the object and around the building in which the magnetometer 1 fixed to the object is located. Finally, the local and natural magnetic field around the magnetometer 1 can vary particularly due to modifications in the magnetic conditions around this magnetometer induced particularly by passing visitors. Other reasons for the mobility of the object and therefore the magnetometer may be due to the nature of the object. For example in the case of a painting, the painting may be sensitive to drafts causing slight local movements of the canvas and possibly the frame of the painting, depending on how it is fixed. Finally, weather conditions can induce large temporary variations in the local magnetic field, particularly in the case of a magnetic storm. For all these reasons, it may be preferable to use means of filtering local variations of the rotation vector due to all the transient and parasite phenomena that have just been described, rather than defining a fixed threshold of the rotation vector in advance. This is why the rotation vector in the preferred embodiment as calculated by the processing means 3 is filtered in the filtering and detection means 4. These means are used to determine an adaptive average value of the noise of the magnetometer rotation vector. This adaptive average value is multiplied by a false alarm safety factor to give an adaptive threshold. When the value of the rotation vector exceeds the adaptive threshold thus defined, the logical state of the filter and detection means 4 changes, generating a message for the message sending means 6. The sending means 6 preferably continuously and periodically send a message towards the reception station 9. When no rotation is detected with an amplitude greater than the threshold, the message is a presence message. When a rotation greater than the predetermined threshold is detected, an alert message is sent immediately.

Advantageously, the presence and alert messages comprise a set of signals identifying the object on which the device 10 is fixed and/or the location of the object in the monitored enclosure, for example the museum. In one improved version shown in FIG. 1, the device 40 for measuring the rotation also comprises an inclinometer 2 connected to the processing means 3. In this case, the processing means 3 generate the object rotation vector taking account of data firstly from the magnetometer and secondly from the inclinometer. This device makes it even more difficult to decoy the rotation detection.

Figure 2:
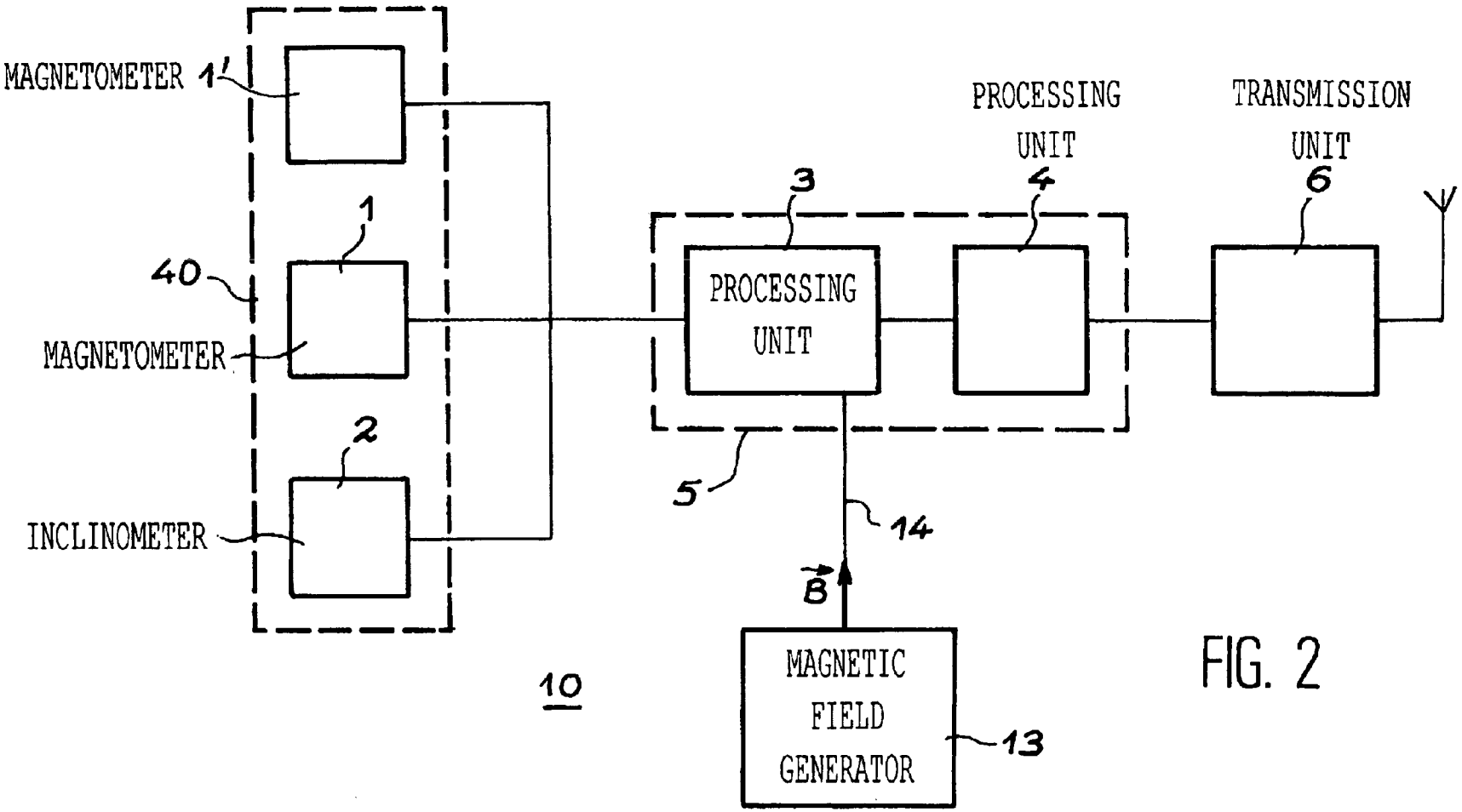
FIG. 2 shows variants of the example embodiment shown in FIG. 1.

A further improved version will now be described with reference to FIG. 2.

Figure 3:
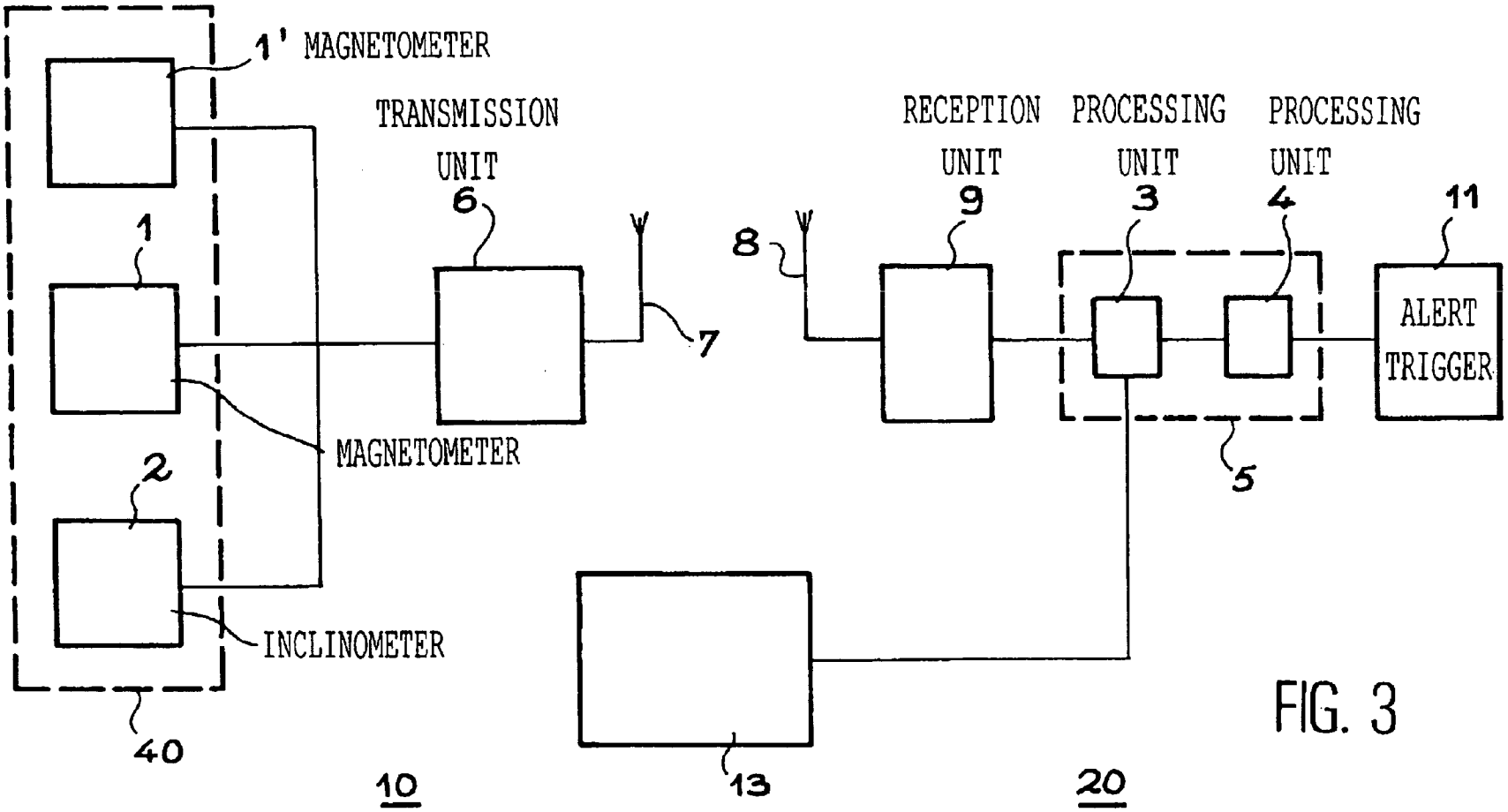
FIG. 3 shows other variant embodiments.

In this figure, elements with the same function as the elements in the example embodiment in FIG. 1 have the same reference numbers. Compared with FIG. 1, the device shown in FIG. 2 comprises one or more additional magnetometers 1' distributed on the surface of the object to be protected and/or in its immediate vicinity. These magnetometers 1' are connected to the processing means 3. With this set of magnetometers 1, 1', it is possible to calculate a value and a direction of the magnetic field with respect to a reference coordinate system related to the object to be protected. When this field is rotated with respect to this coordinate system, or when modifications to its average value in time are made, this modification is detected by the measurement means 40 and the processing and filtering means 5 that, in this case, must be adapted to this function, and an alert message is sent. This modification to the device is particularly useful to detect movements of metallic objects towards the object to be protected. According to an improved version of the version that has just been commented on, the invention may comprise a magnetic field generator 13. This generator generates a magnetic field continuously or at random, which will facilitate the calculation of a modification to the magnetic field due to the presence of an external metallic object. The generator 13 also causes a local variation of the magnetic field such that the modulus and direction of the local magnetic field vector vary in space. Therefore, it becomes possible to detect an arbitrary rotation and/or translation movement. The characteristics of the magnetic field provoked by the generator 13 are transmitted through a link 14 to the calculation means 3. In the examples shown in FIGS. 1 and 2, the processing means 3 and 4 are located on the side of the object. These processing means may also be arranged on the side of the monitoring station as shown in FIG. 3.

In this case, the measurement means 40 composed of one or several magnetometers 1, 1' as in the previous case and possibly inclinometers 2 are coupled to a transmitter 6. In this case, the processing means 3, 4 are placed on the output side of a receiver 9. These means 3, 4 are directly coupled to the alert trigger 11. Like the previous versions, this version may comprise a magnetic field generator 13 that in this case is coupled to the processing means 3, 4 located on the side of the monitoring station. This version of the invention operates like the previous version. In this case the presence message is compulsory. It is composed of measurement transmissions. Lack of a transmission will trigger a particular message from the processing means 3, 4 by means of the alert trigger 11. An alert message is not the same as a presence message. Although the presence message can only comprise an identification, the alert message also contains a code, which triggers the alert when it is received at the monitoring station. The code may consist of a simple change in the transmission frequency. The device described with reference to FIGS. 1 to 3 has been described as an isolated device inside an enclosure. It is obvious that the objects to be protected, particularly in a museum, are not isolated and that there may be several thousand objects to be protected within a given restricted enclosure. Therefore, there is a problem with the management of presence messages and alert messages for all objects to be protected within the enclosure. When the connections between the transmission means 6 and the reception means 9 are point to point links, for example wire or infrared links, it is possible to identify the object by the source of the message received on the reception means. On the other hand, there is a frequency management problem when the connection between the transmission means 6 and the reception means 9 is electromagnetic.

This problem may be solved either by allocating a frequency to each object, or by a programmed or random distribution of transmission time slots from each object in time, or by a combination of the two methods, in other words allocation of different frequencies and distribution of transmission time slots for each frequency.

What is claimed is:

1. A device for triggering an alert or a pre-alert when a normally immobile object is detected to move, the device comprising:

measurement means for generating measured values;

transmission means receiving the values measured by the measurement means and for transmitting the values to processing means for processing the values, and for transmitting the measured values;

message transmission means controlled by the processing means; and monitoring means comprising, means for receiving the message sent by the message transmission means, and means for triggering the alert, wherein the measurement means comprises at least one magnetometer with at least one axis fixed to the object and for measuring a magnetic field along the at least one axis, wherein the processing means accomplishes at least one of (a) calculating a vector magnitude representative of a movement and (b) generating a movement detection signal by comparing the calculated vector magnitude with a threshold vector magnitude, based on a series of measurements from the measurement means, and wherein the means for triggering the alert is coupled to the processing means and sends an alert message on reception of the detection signal from the processing means.

2. An assembly for triggering an alert according to claim 1, wherein the threshold vector magnitude is a memorized magnitude.

3. An assembly for triggering an alert according to claim 1, wherein the threshold vector magnitude is a variable magnitude calculated by the processing means and is variable as a function of an adaptive value calculated from at least a most recently measured vector magnitude.

4. An alert assembly according to claim 1, wherein the processing means is located at a distance from the object.

5. An alert assembly according to claim 2, wherein the processing means is located at a distance from the object.

6. An alert assembly according to claim 3, wherein the processing means is located at a distance from the object.

7. An alert assembly according to claim 1, wherein the processing means is on the object.

8. An alert assembly according to claim 2, wherein the processing means is on the object.

9. An alert assembly according to claim 3, wherein the processing means is on the object.

10. An alert assembly according to claim 7, wherein the measurement means fixed to the object further comprises at least one inclinometer with at least one axis.

11. A measurement assembly according to claim 7, wherein the means for transmitting a message further periodically sends a presence message.

12. An alert assembly according to claim 1, wherein the processing means comprises a Kalman filter.

13. A monitored object, comprising:

at least one magnetometer with at least one axis fixed to the object;

means for processing measured values from the at least one magnetometer to detect a rotation movement of the object and to transmit a detection signal; and message transmission means coupled to the processing means for sending an alert message on reception of the detection signal.

14. A process for monitoring at least one object in which each object communicates with a monitoring station, wherein at an object end:

values of a magnetic field are measured on at least one axis related to the at least one object;

measurement results are transmitted to the monitoring station, the transmission including a presence message; and at a monitoring station end:

a vector magnitude representative of a movement is calculated from a series of measurements;

a movement detection signal may be produced by comparison of the calculated vector magnitude with a threshold vector magnitude;

an absence message is sent if the presence message is not received during a time exceeding a given duration; and an alert is triggered if an object movement detection signal is produced.

15. The process according to claim 14, wherein the calculation of the vector magnitude representative of a movement and the generation of a movement detection signal by comparison of the calculated vector magnitude with a threshold vector magnitude, starting from a set of measurements, are made at the object end instead of at the monitoring station end, and a presence message or alert message is sent periodically from the object end if a detection signal occurs, and at the monitoring station end:

a particular message is sent if there is no presence message for a time exceeding the given duration, and the alert is triggered if an alert message is received from the at least one object.

* * * * *